US006478549B1

(12) United States Patent
Aden et al.

(10) Patent No.: US 6,478,549 B1
(45) Date of Patent: Nov. 12, 2002

(54) HYDRAULIC PUMP WITH SPEED DEPENDENT RECIRCULATION VALVE

(75) Inventors: David R. Aden, Saginaw, MI (US); Thomas C Rytlewski, Auburn, MI (US); Jerod M. Etienne, Freeland, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/489,437

(22) Filed: Jan. 21, 2000

(51) Int. Cl.[7] ..... F04B 49/00
(52) U.S. Cl. ..... 417/300; 417/307; 417/310
(58) Field of Search ..... 417/310, 300, 417/307

(56) References Cited

U.S. PATENT DOCUMENTS

| | | | | |
|---|---|---|---|---|
| 4,289,454 A | * | 9/1981 | Iwata | 417/300 |
| 4,311,161 A | * | 1/1982 | Narumi et al. | 137/117 |
| 4,599,051 A | | 7/1986 | Numazawa et al. | 417/293 |
| 5,236,315 A | * | 8/1993 | Hamao et al. | 417/295 |
| 5,513,960 A | * | 5/1996 | Uemoto | 417/300 |
| 5,609,474 A | | 3/1997 | Ohno | 417/288 |

FOREIGN PATENT DOCUMENTS

| | | | |
|---|---|---|---|
| EP | 0522505 | 1/1993 | F04C/15/04 |
| JP | 61125966 | 6/1986 | B62D/5/07 |

* cited by examiner

*Primary Examiner*—Charles G. Freay
*Assistant Examiner*—Timothy P. Solak
(74) *Attorney, Agent, or Firm*—Edmund P. Anderson

(57) ABSTRACT

This invention offers advantages and alternatives over the prior art by providing a dual port hydraulic fixed displacement pump which exhibits improved efficiency by limiting the volume of discharged fluid which is subjected to the line pressure of a hydraulic system through mechanical valve control. According to the present invention, a pair of discharge ports are provided, namely a first discharge port and a second discharge port. Under all operating conditions, e.g., low and high pump speed operating conditions, the fluid flowing within the first discharge port and primary discharge passageway is exposed to the working pressure of the primary line, which represents a high pressure line. The second discharge port fluidly communicates with a secondary discharge passageway which is in selective fluid communication with a low pressure line connected to a low pressure area of the pump (e.g., a reservoir) under first operating conditions and is also in selective communication with the first discharge port and the primary discharge passageway under second operating conditions.

21 Claims, 3 Drawing Sheets

HYDRAULIC PUMP WITH SPEED DEPENDENT RECIRCULATION VALVE

TECHNICAL FIELD

The present invention relates generally to hydraulic pumps.

BACKGROUND OF THE INVENTION

Generally, a fluid powered system, e.g., steering system or transmission system, which is of a hydraulic design uses hydraulic pressure and flow to provide the required fluid power to the system. However, the hydraulic fluid must be pumped and regulated. The hydraulic pump creates the hydraulic force and typically a flow control valve regulates the flow. A conventional vane-type pump comprises a cam (pump) ring having a substantially elliptical cam surface, a rotor which is adapted to rotate within the cam ring and a plurality of vanes adapted to move back and forth within radial slits formed in the rotor. The cam ring is stationary and the outer edges of the vanes touch the inside of the surface of the cam ring. Because of the substantially elliptical shape of the cam ring, the vanes slide in and out of their slots and maintain contact with the inside surface of the cam ring as the rotor turns therein. The volume of each pumping cavity constantly changes due to the elliptically shaped cam ring. Volume increases as the vanes move through the rising portion of the cam ring, drawing fluid through an intake port. When the vanes move into the "falling" portion of the ring contour, volume decreases. Decreased volume increases pressure, forcing fluid out through the discharge port. An intake portion of the hydraulic pump receives low-pressure hydraulic fluid from a pump reservoir. Discharged fluid, under high pressure, flows to a desired system location (e.g., a steering gear to provide power assist).

In fixed displacement pumps, at low engine speeds, the operating system can handle the volume of hydraulic fluid provided by the pump. Flow dramatically increases at higher speeds because the pump draws and discharges a greater volume of fluid. However at high speed operating conditions, the volume of the discharged fluid exceeds the demand of the system but due to the design of the pump, the pump is required to direct all the fluid from the pump and throughout the system. These conditions raise operating temperatures and reduce pump durability. In addition, the torque necessary to drive the pump increases at higher system back pressures which corresponds to additional horsepower (energy) being required to effectively overcome the system back pressure and distribute the fluid throughout the system.

Another pump conventionally used is a variable displacement pump. A variable displacement pump provides a reduction in flow as a function of operating conditions and therefore requires more costly shaft support solutions. Additionally, since variable displacement pumps are typically single stroke, the pumps require a larger package size to provide the same pumping capacity. Variable displacement pump valving also make these pumps less efficient in the full displacement operating condition.

There is a perceived need for a fixed displacement hydraulic pump, preferably a vane-type pump, for use in a vehicle operating system, wherein the pump has improved energy efficiency while at the same time provides adequate hydraulic power.

SUMMARY OF THE INVENTION

This invention offers advantages and alternatives over the prior art by providing a dual port hydraulic fixed displacement pump which exhibits improved efficiency by limiting the volume of discharged fluid which is subjected to the line pressure of a hydraulic system through mechanical valve control. In an exemplary embodiment, the fixed displacement pump comprises a vane-type pump having a vane assembly which includes pumping cavities formed by a plurality of vanes. The constantly changing volume of these pumping cavities as the pump is driven causes fluid to be both drawn into the pumping cavities and forced out of the pumping cavities and through discharge ports of the pump.

According to the present invention, a pair of discharge ports are provided, namely a first discharge port and a second discharge port. The first discharge port fluidly communicates with a primary discharge passageway and discharge outlet which is connected to a primary line for distributing the fluid throughout the system. Under all operating conditions, e.g., low and high pump speed operating conditions, the fluid flowing within the first discharge port and primary discharge passageway is exposed to the working pressure of the primary line, which represents a high pressure line. The second discharge port fluidly communicates with a secondary discharge passageway which is in selective fluid communication with a low pressure line connected to a low pressure area of the pump (e.g., a reservoir) under first operating conditions and is also in selective communication with the first discharge port and the primary discharge passageway under second operating conditions. The first operating conditions comprise high speed operating conditions (e.g., pump speeds above 2500 rpm) where pump output exceeds system fluid demands and the second operating conditions comprise low speed operating conditions where system demands require full pump capacity.

A flow control valve is disposed within the pump and acts to direct the fluid flowing within the secondary discharge passageway according to either a second discharge path, wherein the fluid is directed to the low pressure line and the low pressure reservoir or sump of the system, or a third discharge path, wherein the fluid is directed to the primary discharge passage and is subjected to the high pressure line of the system. In an exemplary embodiment, the flow control valve comprises a hydromechanically controlled valve which is designed to actuate when the fluid flowing within the secondary discharge passageway reaches a predetermined flow rate. Upon actuation, all of the fluid flowing through the secondary discharge passageway is directed to the low pressure line instead of the high pressure line of the primary discharge passageway. As a result, only fluid flowing in the primary discharge passageway is exposed to the high pressure of the system line and the fluid within the secondary passageway is subjected to a much lower pressure in the low pressure line.

The pump preferably further includes a check valve which is placed between the primary and secondary discharge passageways to control backflow from the primary discharge passageway when the secondary discharge passageway is exposed to low pressure.

Consequently, the torque to drive the pump is significantly reduced and thus a considerable reduction in horsepower is achieved because all of the fluid is not exposed to the high back pressure of the primary line. In practice, the flow control valve is actuated under high pump speed operating conditions (e.g., above 2500 rpm) where the pump output significantly exceeds system demands. Under low pump speed operating conditions when system demands require full pump capacity, the flow control valve is not actuated and all of the fluid within the secondary discharge passageway is directed to the primary discharge passageway and is exposed to the high pressure line of the system so that the system demands are satisfied.

The above-described and other features and advantages of the present invention will be appreciated and understood by those skilled in the art from the following detailed description, drawings, and appended claims.

DETAILED DESCRIPTION OF THE INVENTION

Figure 1:
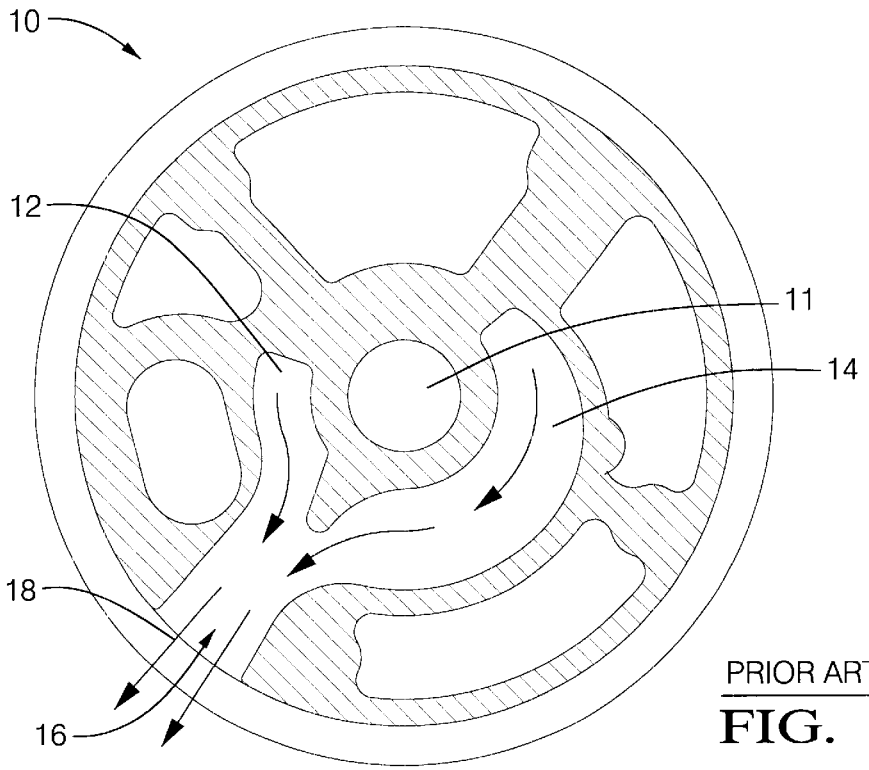
PRIOR ART FIG. 1
FIG. 1 is a cross sectional view of a conventional pump illustrating the design of the discharge ports of the pump.
Figure 2:
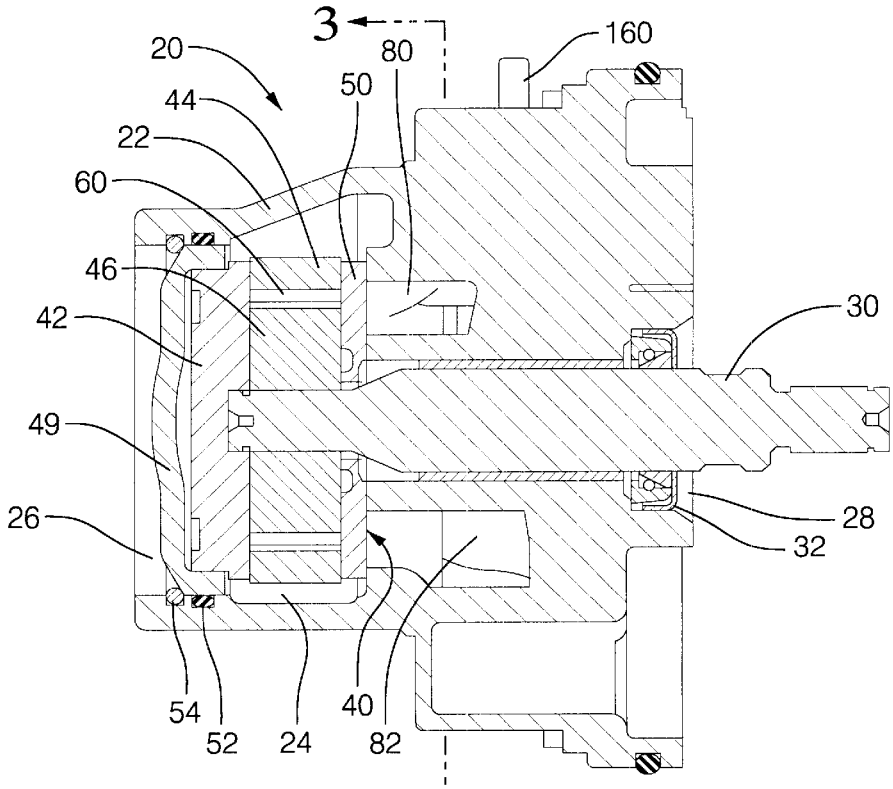
FIG. 2 is a cross sectional elevational view of an exemplary vane-type pump in accordance with the present invention.

FIG. 1 is a cross sectional view of a typical conventional vane-type pump showing the discharge ports and fluid flow paths of the pump. The vane-type pump is generally indicated at 10 and comprises a pump having dual internal discharge ports. As is known in the art, the vanes within the rotor and the cam ring (all not shown) define pumping cavities. More specifically, the space between the rotor, ring and any two adjacent vanes defines a single pumping cavity. The rotation of the rotor and movement of the vanes causes the volume of each pumping cavity to constantly change due to the shape of the cam ring which is typically oval-shaped (elliptical). As the vanes move through the "rising" portion of the cam ring, the volume of each pumping cavity increases resulting in the fluid being drawn through an intake port of the pump. The vane assembly is driven by a drive shaft 11. Conversely when the vanes move into the "falling" portion of the cam ring contour, the volume of each pumping cavity decreases. Decreased volume within the pumping cavity causes an increase in pressure within each pumping cavity resulting in the fluid being forced out of the pumping cavity and through the discharge ports of the pump 10.

The illustrated vane-type pump 10 shown in FIG. 1 includes a first discharge port 12 and a second discharge port 14. In this design, first and second discharge ports 12 and 14 are routed to a common discharge outlet generally indicated at 16. In other words, first and second discharge ports 12 and 14 join at a common discharge outlet 16 as the fluid is pumped to a desired system location. The fluid flow path from the first and second discharge ports 12 and 14 is generally indicated by directional arrows 18. In this example, pump 10 is required to force the fluid through the common discharge outlet 16 and the fluid works against system back pressure. Because of the back pressure which is observed in the system, in order for pump 10 to effectively distribute the fluid through the overall system, pump 10 must force the fluid at such a flow rate that the fluid overcomes the back pressure of the system and is therefore effectively distributed throughout the system. In this type of pump design, the fluid passing through both the first and second discharge ports 12 and 14 must work against the system back pressure. The operating system in which pump 10 is being used requires a certain fluid flow rate so that a sufficient amount of fluid is pumped throughout the system for proper operation thereof and in this design, pump 10 distributes all the fluid throughout the system. As is known, the energy consumption of the pump is linked to the amount of torque required to drive the unit and as the torque increases, an increase in horsepower is likewise observed and energy consumption rises. With this type of pump design, at higher operating conditions, the pump output in terms of forcing fluid through the system at a certain flow rate exceeds the system demands. Such a pump is termed a fixed displacement pump because as the speed of the pump increases, the flow rate correspondingly increases. Consequently, at high pump speeds, the flow rate is unnecessarily high and the flow rate of the fluid exceeds the demands of the system. Pump 10 is therefore operating at less than efficient conditions because all of the discharged fluid is exposed to the working line pressure of the system.

Referring to FIGS. 2–5. According to the present invention, a dual port hydraulic fixed displacement pump is made more efficient by limiting the volume of the discharged fluid, e.g. oil, which is subjected to the line pressure of the hydraulic system. More specifically, the present invention may be incorporated into a number of types of pumping assemblies, including piston pumps, vane-type pumps and gear pumps; however, for the purpose of illustration only, the present invention is described with reference to an exemplary dual port hydraulic fixed displacement vane-type pump. It being understood that one of skill would appreciate that the improved efficiency dual discharge port design of the present invention may be incorporated into these other pump assemblies besides the illustrated vane-type pump. The exemplary vane-type pump is generally indicated at 20 in FIG. 2. As previously discussed, the term "fixed displacement pump" refers to a pump in which an increase in the speed of the pump leads to a corresponding increase in the flow rate of the discharged fluid.

A conventional pump inlet port 160 is used to provide fluid from a fluid powered system, e.g., steering system or transmission system.

Vane-type pump 20 includes a pump housing 22 having an internal housing cavity 24 with a large opening 26 at one end thereof and a smaller opening 28 at the other end thereof. A drive shaft 30 extends through the smaller opening 28 and is rotatably supported in a shaft bearing 51 which is secured in the opening 28 and is contacted by a shaft seal 32 also secured within the opening 28. Adequate shaft support is placed in the assembly to deal with bending loads which result from the unbalanced condition when pump 20 is operating in a fuel efficient mode. The shaft seal 32 functions to prevent atmospheric air from entering the pump 20 and low pressure fluid leakage from pump 20.

The housing cavity 24 is substantially filled with a vane pump assembly, generally designated at 40, and includes a pressure plate 42, a cam ring 44, a rotor 46, a plurality of vanes (not shown), and an end cover 49 and thrust plate 50. The end cover 49 cooperates with annular seal ring 52 and a locking ring 54 to close the large opening 26.

The rotor 46 includes a plurality of slots in which the plurality of vanes are slidably disposed as is known in the art. The plurality of vanes contact the inner surface of cam ring 44 so as to provide a plurality of peripheral pumping chambers 60 which expand and contract upon the rotation of rotor 46 when it is driven by a drive shaft 30. The thrust plate 50 includes discharge porting arrangements as will be described in greater detail hereinafter to effectively direct the forced fluid from vane assembly 40 to discharge passageways and outlets of the pump 20 which act to distribute the fluid to the other components of the system. The discharged fluid from the pumping chambers 60 of the vane assembly 40 passes through the thrust plate 50 to first and second discharge ports 80 and 82, respectively, which in turn are in fluid communication with a pump discharge passage (not shown in FIG. 2) formed in pump 20.

Figure 3:
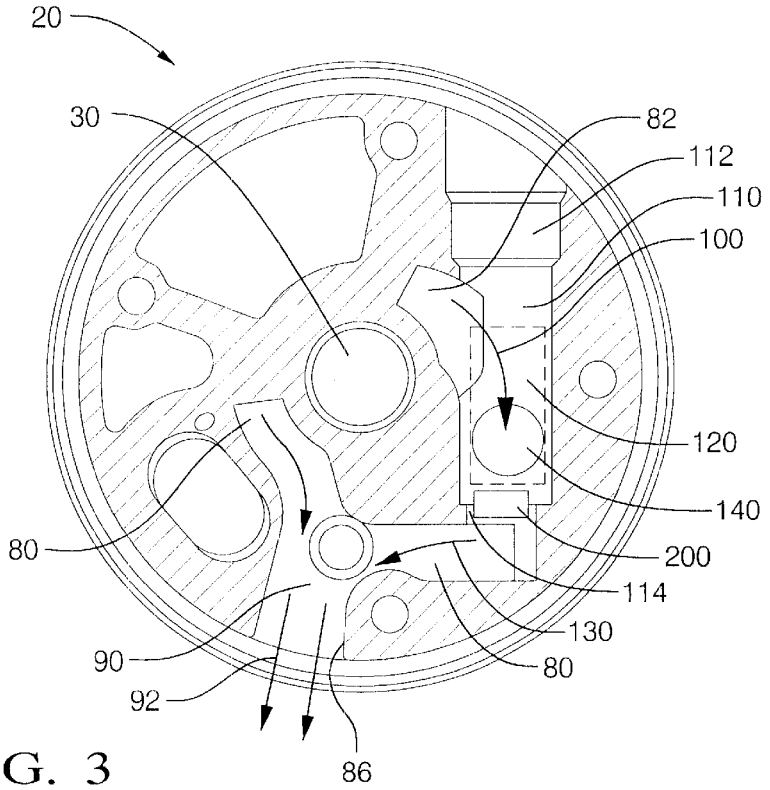
FIG. 3 is a cross sectional view taken along the line 3—3 of FIG. 2.

Referring now to FIG. 3 in which a cross sectional view of the exemplary pump 20 is shown. FIG. 3 illustrates the dual fluid discharge port design of the pump 20. First discharge port 80 fluidly communicates with a discharge outlet 86 which serves to route the discharged fluid within a system line to components of the system, whether it be gear assemblies in a power steering system or transmission components in a transmission assembly. As in the conventional pump 10 shown in FIG. 1, the first discharge port 80 is part of a primary discharge passageway 90 for the fluid to flow in response to the pumping action. In FIG. 3, a primary discharge path in which the fluid flows from first discharge port 80 is illustrated by directional arrows 92. Because the first discharge port 80 is directly connected to the pump discharge outlet 86, this primary discharge passageway 90 is exposed to working line pressure of the system under all operating conditions of the pump. In other words, at either low speed or high speed operating conditions, pump 20 must work against the line pressure of the system in order to effectively distribute fluid according to the primary discharge path 92 as the fluid is distributed throughout the system.

According to the present invention, second discharge port 82 partially defines a second discharge path for the fluid to flow in response to the action of pump 20. In the exemplary and illustrated embodiment, second discharge port 82 fluidly communicates with a secondary discharge passageway 110 so that fluid flowing through second discharge port 82 is directed to secondary discharge passageway 110. Secondary discharge passageway 110 has a first portion 112 and a second portion 114, wherein second portion 114 is in selective fluid communication with first discharge port 80 and permits the discharged fluid within secondary discharge passageway 110 to join the fluid flowing through first discharge port 80 under selective operating conditions, as will be described in greater detail hereinafter.

Secondary discharge passageway 110 includes a flow control valve 120 which is generally disposed between first and second portions 112 and 114 thereof. Flow control valve 120 is designed to direct the fluid flowing within secondary discharge passageway 110 according to either a second discharge path which is illustrated in FIG. 3 by directional arrows 100 or a third discharge path generally indicated by directional arrows 130. In other words, flow control valve 120 dictates whether the fluid flowing within secondary discharge passageway 110 is exposed to the high working line pressures observed in the primary discharge passageway 90 when the fluid flows according to the second discharge path 100 or a lower pressure observed in line 140 which is connected to a low pressure area of the overall system when the fluid flows according to the third discharge path 130. For example, the low pressure area of the system may comprise a reservoir 150 or a low pressure sump (FIGS. 4–5).

Figure 4:
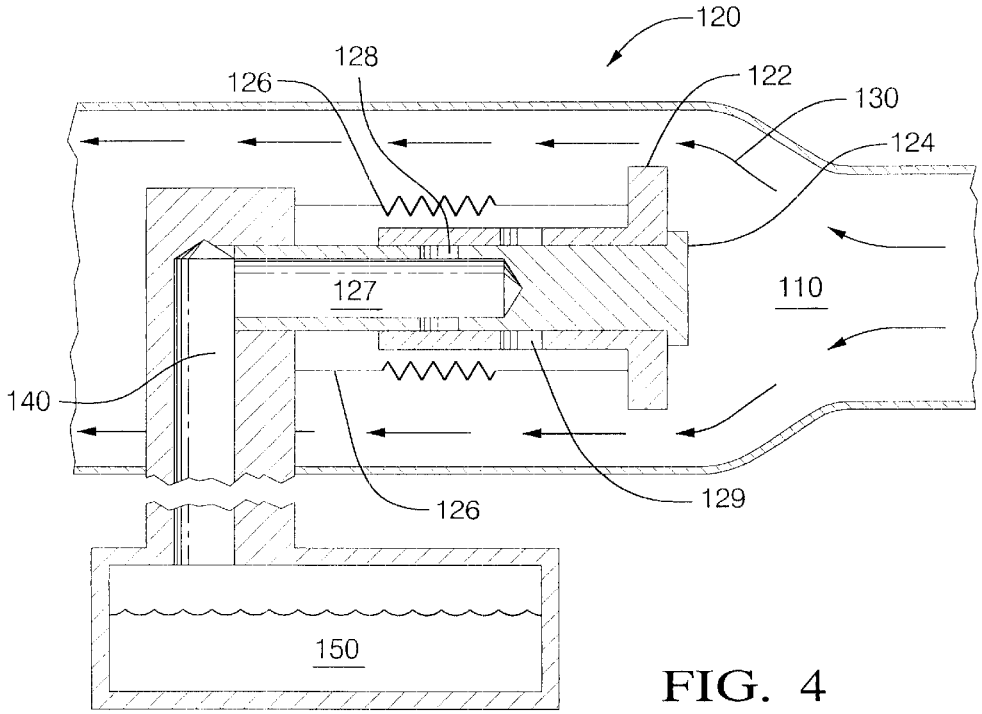
FIG. 4 is a sectional side view of an exemplary flow control valve of FIG. 3 showing the valve in a closed position.
Figure 5:
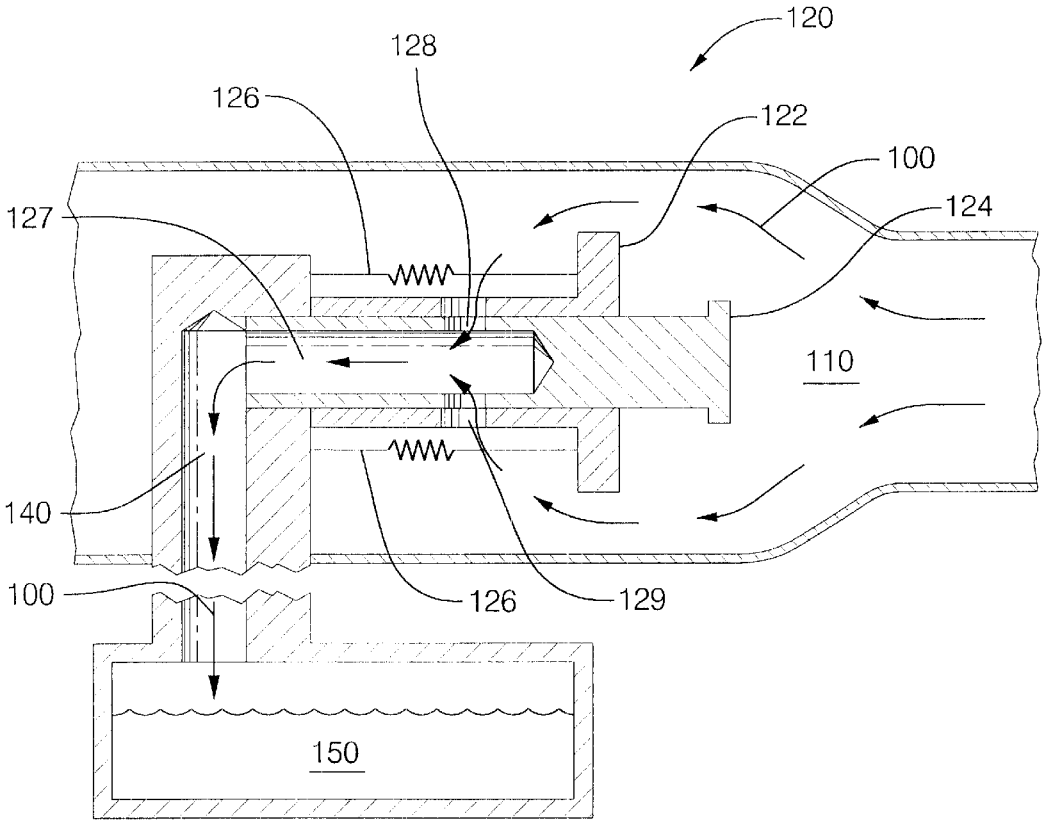
FIG. 5 is a sectional side view of the exemplary flow control valve of FIG. 3 showing the flow control valve in an open position.

Referring to FIGS. 3–5, flow control valve 120 may comprise any number of suitable valves which are designed to actuate upon the occurrence of a predetermined event, such as when the fluid flowing within secondary discharge passageway 110 exceeds a predetermined flow rate or pump 20 obtaining a predetermined speed operating condition (e.g., rpm). In an exemplary embodiment, flow control valve 120 comprises a hydro-mechanically controlled valve which is designed to actuate when the fluid flowing within the secondary discharge passageway 110 reaches a predetermined flow rate. Upon actuation of flow control valve 120, all of the fluid flowing through second discharge port 82 and secondary discharge passageway 110 is directed to a low pressure line 140 which fluidly communicates with the low pressure area of the system (e.g, reservoir 150). Low pressure line 140 comprises a fluid carrying member (e.g., tubular member) which routes the fluid therethrough to the low pressure system area.

As best shown in FIG. 5, flow control valve 120 includes a moveable slider 122 and a guide 124, with the slider 122 shown displaced against the force of spring 126, thereby opening ports 128 to the low pressure outlet 127 and on to the low pressure line 140, wherein the fluid is directed to reservoir 150. The intake ports 128 are cross drilled holes in the guide 124 and coincide with cross-drilled holes 129 in the slider 122 when the slider is in this position. In this embodiment, flow control valve 120 is mechanically actuated by the flow force acting on the valve 120 which causes the valve 120 to open once the fluid reaches or exceeds a predetermined flow rate, dependent upon the strength of the spring 126 and the coefficient of drag of the slider 122 given a hydraulic fluid of known viscosity. As is known, because flow control valve 120 is mechanically actuated in response to the observed flow force, the valve 120 may be conveniently tuned so that valve 120 opens at any given predetermined flow rate. For example, the springs 126 may be adjusted or tuned to vary the flow force required to cause the valve 120 to actuate and open.

Advantageously, in this open position, flow control valve 120 directs all of the fluid flowing within the secondary passageway 110 to low pressure line 140 and ultimately to reservoir 150. Because low pressure line 140 has a significantly lower pressure than the system pressure which is observed in the primary discharge passageway 90, the fluid will flow into low pressure line 140 instead of primary discharge passageway 90 because of the difference in pressures between the two lines.

FIG. 4 illustrates flow control valve 120 in a non-actuated or closed position, wherein the fluid is prevented from flowing through iintake ports 128 to low pressure line 140. Accordingly, the fluid flows within secondary discharge passageway 110 around the flow control valve 120 and the low pressure line 140. In this closed position, the fluid is directed through the secondary discharge passageway 110 to the primary discharge passageway 90 and both passageways 90, 110 join together prior to the fluid exiting pump 20 at pump discharge outlet 86. Under these conditions, all of the fluid flowing through pump 20 is exposed to the working high pressure line of the system and none of the fluid is directed to the low pressure area (reservoir 150) of the system. In this position, the fluid flow rate within the secondary discharge passageway 110 has not reached or exceeded the predetermined flow rate and therefore, the flow control valve 120 is not actuated. These conditions are commonly observed under low pump speed conditions when the system demands full pump capacity.

It is further understood that flow control valve 120 may be disposed external to the pump 20 provided that the primary and secondary discharge passageways 90, 110 are separated within pump 20 and fluidly communicate with a separate discharge outlet. The separated primary and secondary discharge passageways 90, 110 join one another in the system itself and flow control valve 120 is preferably disposed in the secondary passageway 110 proximate where the two passageways join so that the fluid is controlled in the manner described above.

Referring to FIGS. 2–5, pump 20 further includes a check valve 200 disposed between the primary discharge passageway 90 and the secondary discharge passageway 110. Check valve 200 serves to selectively link the primary and secondary passageways, 90 and 110, respectively, together with one another under predetermined operating conditions. As is known in the art, check valve 200 permits fluid to flow in one direction, namely in this embodiment, from secondary discharge passageway 110 to primary discharge passageway 90 when pump 20 is operating at low speed conditions and the system demands require full pump capacity. The check valve 200 controls backflow from the primary discharge passageway 90 when the secondary passageway 110 is exposed to low pressure. In other words, the check valve 200 is necessary because the primary and secondary discharge passageways 90 and 110 are joined at a common location (generally where check valve 200 is disposed) and upon actuation of flow control valve 120, the fluid flowing within the primary discharge passageway 90 will want to flow to the low pressure area of the system instead of flowing in the high pressure system line (primary discharge passageway 90). This would result in a backflow of fluid from the primary discharge passageway 90 to the secondary discharge passageway 110 and low pressure line 140 and fluid would not be distributed to the operating system itself. The operation of check valve 200 is known in the art; however, for the purpose of simplicity the pressure of fluid from the primary discharge passageway 90 on the side of check valve 200 facing the primary discharge passageway 90 causes the check valve 200 to close and prevent fluid from flowing to the secondary discharge passageway 110. Other suitable check valves 200 may be used according to the present invention so long the check valve 200 prevents fluid backflow when flow control valve 120 is actuated.

In practice, the flow control valve 120 will direct all of the fluid within secondary discharge passageway 110 into the primary discharge passageway 90 and the working primary line of the system under low pump speed conditions when system demands require full pump capacity. However, in high speed operating conditions (e.g., speeds above 2500 rpm) where pump output significantly exceeds system demands, flow control valve 120 directs the fluid within secondary discharge passageway 110 back to the low pressure area of the system (e.g., reservoir 150) via the low pressure line 140. As a result, only fluid within the primary discharge passageway 90 is exposed to the line pressure of the system and fluid within the secondary discharge passageway 110 is not exposed to this high line pressure of the system. Consequently, the torque required to drive pump 20 is significantly reduced and thus a considerable reduction in horsepower is achieved resulting in improved efficiency and improved operating costs. As a result, a fuel economy savings to a vehicle is realized and other advantages of pump 20 of the present invention is a reduction in operating temperatures and noise.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A hydraulic fluid pump for use with a fluid powered system comprising:

a first pump discharge outlet for delivering fluid to the system from the pump;

a pump inlet port for accepting fluid from the system;

a vane assembly including a rotor, a cam, and a plurality of vanes cooperating to form a plurality of expansible pump chambers for transferring fluid from the inlet port to the first discharge outlet;

a first discharge port in fluid communication with the pump chambers and a primary discharge passageway, the primary discharge passageway being in fluid communication with the first discharge outlet and directs fluid thereto from the first discharge port, the primary discharge passageway being exposed to a first system line pressure;

a second discharge port in fluid communication with the pump chambers and a secondary discharge passageway, the secondary discharge passageway being in selective communication with the primary discharge passageway and in selective communication with a second discharge outlet connected to a low pressure chamber by a secondary line, the secondary line being exposed to a second system line pressure; and a flow control valve disposed within the secondary discharge passageway, wherein actuation of the flow control valve causes the fluid flowing within the secondary discharge passageway to be directed to the second discharge outlet and through the secondary line to the low pressure chamber of the system.

2. The hydraulic fluid pump as set forth in claim 1, further including:

a check valve disposed between the primary discharge passageway and the secondary discharge passageway, the check valve permitting fluid to flow from the secondary discharge passageway to the primary discharge passageway while preventing fluid from flowing from the primary discharge passageway to the secondary discharge passageway.

3. The hydraulic fluid pump as set forth in claim 1, wherein the low pressure chamber comprises a reservoir or sump.

4. The hydraulic fluid pump as set forth in claim 1, wherein fluid flowing within the secondary discharge passageway fluidly communicates with the primary discharge passageway and exits the pump at the first discharge outlet under first pump operating conditions.

5. The hydraulic fluid pump as set forth in claim 4, wherein the first pump operating conditions comprise low pump speeds.

6. The hydraulic fluid pump as set forth in claim 1, wherein fluid flowing within the secondary discharge passageway fluidly communicates with the second discharge outlet and secondary line and flows to the low pressure chamber under second pump operating conditions.

7. The hydraulic fluid pump as set forth in claim 5, wherein the second pump operating conditions comprise high pump speeds.

8. The hydraulic fluid pump as set forth in claim 7, wherein the high pump speeds comprise pump speeds where fluid output exceeds system demands.

9. The hydraulic fluid pump as set forth in claim 1, wherein the first system line pressure is greater than the second system line pressure.

10. The hydraulic fluid pump as set forth in claim 1, wherein the flow control valve actuates when the fluid flowing within the secondary discharge passageway has a predetermined flow rate.

11. The hydraulic fluid pump as set forth in claim 1, wherein the flow control valve comprises a hydromechanically controlled valve.

12. The hydraulic fluid pump as set forth in claim 1, wherein the fluid powered system comprises a vehicle operating system selected from the group consisting of a power steering system, a transmission assembly, and a hydraulic engine cooling system.

13. A hydraulic fluid pump for use with a system comprising:

a first pump discharge outlet for delivering fluid to the system from the pump;

a pump inlet port for accepting fluid from the system;

a pump assembly having at least one pump chamber for transferring fluid from the inlet port to the first discharge outlet;

a first discharge port in fluid communication with the at least one pump chamber and a primary discharge passageway, the primary discharge passageway being in fluid communication with the first discharge outlet and directs fluid thereto from the first discharge port, the primary discharge passageway being exposed to a first system line pressure;

a second discharge port in fluid communication with the at least one pump chamber and a secondary discharge passageway, the secondary discharge passageway being in selective communication with the primary discharge passageway and in selective communication with a second discharge outlet connected to a low pressure chamber by a secondary line, the secondary line being exposed to a second system line pressure; and a flow control valve disposed within the secondary discharge passageway, wherein actuation of the flow control valve causes the fluid flowing within the secondary discharge passageway to be directed to the second discharge outlet and through the secondary line to the low pressure chamber of the system.

14. The hydraulic fluid pump as set forth in claim 13, wherein the pump assembly comprises a vane assembly including a rotor, a cam, and a plurality of vanes cooperating to form a plurality of pump chambers.

15. The hydraulic fluid pump as set forth in claim 13, further including:

a check valve disposed between the primary discharge passageway and the secondary discharge passageway, the check valve permitting fluid to flow from the secondary discharge passageway to the primary discharge passageway while preventing fluid from flowing from the primary discharge passageway to the secondary discharge passageway.

16. The hydraulic fluid pump as set forth in claim 13, wherein the low pressure chamber comprises a reservoir or sump.

17. The hydraulic fluid pump as set forth in claim 13, wherein fluid flowing within the secondary discharge passageway fluidly communicates with the primary discharge passageway and exits the pump at the first discharge outlet under first pump operating conditions and fluidly communicates with the second discharge outlet and secondary line and flows to the low pressure chamber under second pump operating conditions.

18. The hydraulic fluid pump as set forth in claim 17, wherein the first pump operating conditions comprise low pump speeds and the second pump operating conditions comprise high pump speeds.

19. The hydraulic fluid pump as set forth in claim 18, wherein the high pump speeds comprise pump speeds where fluid output exceeds system demands.

20. The hydraulic fluid pump as set forth in claim 13, wherein the first system line pressure is greater than the second system line pressure.

21. The hydraulic fluid pump as set forth in claim 13, wherein the flow control valve actuates when the fluid flowing within the secondary discharge passageway has a predetermined flow rate.

* * * * *